United States Patent [19]

Ross

[11] 4,372,695

[45] Feb. 8, 1983

[54] PRINTING APPARATUS

[76] Inventor: William L. Ross, Barnsgate, Herons Ghyll, Nr. Uckfield, Sussex, England

[21] Appl. No.: 168,377

[22] Filed: Jul. 10, 1980

Related U.S. Application Data

[63] Continuation-in-part of Ser. No. 65,378, Aug. 9, 1979, abandoned, which is a continuation of Ser. No. 915,503, Jun. 14, 1978, abandoned.

[30] Foreign Application Priority Data

Jun. 16, 1977 [GB] United Kingdom ..... 25281/77

[51] Int. Cl.[3] ..... B41J 3/10; B41J 3/16; B41J 27/16

[52] U.S. Cl. ..... 400/119; 101/DIG. 13; 346/155

[58] Field of Search ..... 101/DIG. 13; 346/155, 346/156; 400/119

[56] References Cited

U.S. PATENT DOCUMENTS

| | | | |
|---|---|---|---|
| 2,777,745 | 1/1957 | McNaney | 101/DIG. 13 |
| 2,841,461 | 7/1958 | Gleason | 101/DIG. 13 |
| 2,934,649 | 4/1960 | Walkup | 101/DIG. 13 |
| 2,955,894 | 10/1960 | Epstein | 101/DIG. 13 |
| 3,052,564 | 9/1962 | Kulesza | 101/DIG. 13 |
| 3,198,648 | 8/1965 | Trimbur | 101/DIG. 13 |
| 3,263,234 | 7/1966 | Epstein et al. | 101/DIG. 13 |
| 3,289,209 | 11/1966 | Schwertz et al. | 101/DIG. 13 |
| 3,441,938 | 4/1969 | Markgraf | 101/DIG. 13 |
| 3,767,020 | 10/1973 | Rowe | 400/124 |
| 3,792,659 | 2/1974 | Albrecht | 101/365 |
| 4,051,484 | 9/1977 | Martin | 400/119 X |

FOREIGN PATENT DOCUMENTS

| | | |
|---|---|---|
| 888867 | 2/1962 | United Kingdom . |
| 889664 | 2/1962 | United Kingdom . |
| 1027438 | 4/1966 | United Kingdom . |
| 1225593 | 3/1971 | United Kingdom . |
| 1356643 | 6/1974 | United Kingdom . |
| 1403176 | 8/1975 | United Kingdom . |
| 1511198 | 5/1978 | United Kingdom . |

OTHER PUBLICATIONS

IBM Tech. Disc. Bulletin, J. Greyson, vol. 3, No. 11, Apr. 1961, p. 15.

IBM Tech. Disc. Bulletin, E. P. Damm, Jr., vol. 15, No. 9, Feb. 1973, pp. 2837–2838.

*Primary Examiner*—Paul T. Sewell

*Attorney, Agent, or Firm*—Wood, Herron & Evans

[57] ABSTRACT

A print head in which an electrostatic character image is formed on a print drum by direct contact with electrodes, developed and printed out all within the same revolution of the drum. The characters are generated electronically using a keyboard or data terminal. The drum may be made small and the print head take the form of a hand-held printer. While retaining its small diameter the drum may be extended axially to form a line printer.

5 Claims, 6 Drawing Figures

Fig. 2A.
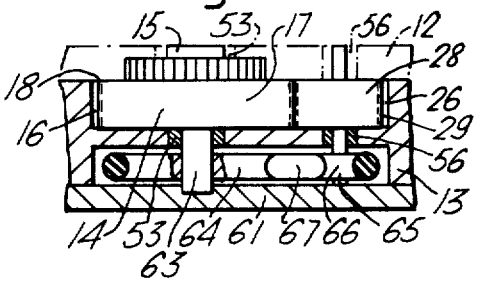
Fig. 3.
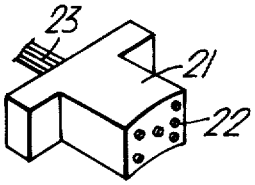
Fig. 4.
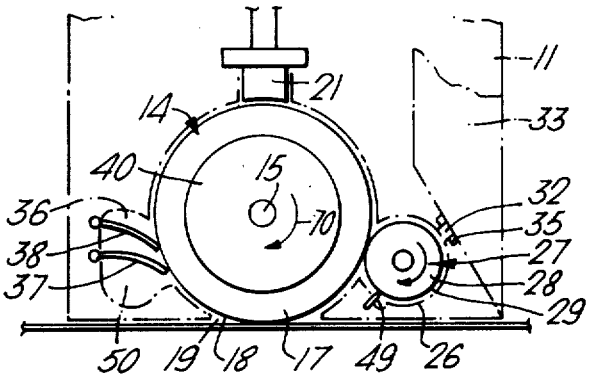
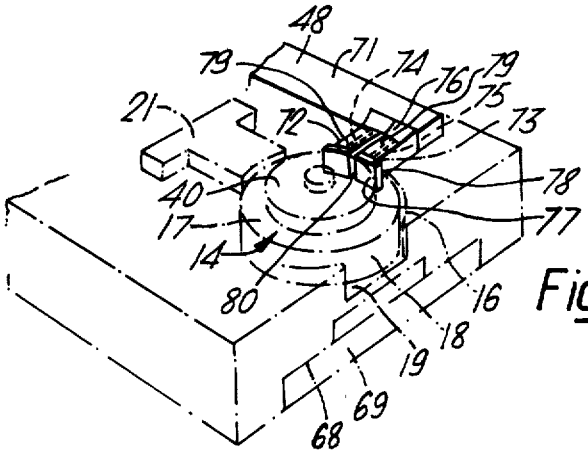
Fig. 5.

PRINTING APPARATUS

RELATED APPLICATIONS

This application is a Continuation-in-Part of my U.S. application Ser. No. 65,378 filed on Aug. 9th, 1979, which in turn was a Continuation of my application Ser. No. 915,503 filed on June 14th, 1978.

DISCUSSION OF PRIOR ART

This invention relates to printing apparatus and in particular to apparatus in which representations of the characters to be printed take the form of erasable electrical charge distributions on the surface of a drum. In such arrangements the electrical manifestations may result from the application of an electrostatic field pattern which itself is representative of the character to be printed to the surface of a dielectric layer, or alternatively may result from the incident of a light image on a charged photoconductive surface formed on the said drum. In both cases the net result is an image in the form of a localised variation of charge on the surface of the drum to which image ink will adhere. This ink may be applied either in a liquid form, or, more conventionally, as a toning powder. The application of the surface of the said drum bearing the inked image to the surface to be printed results in the transference of the ink from the drum to the said printing surface where it is made adherent by normal procedures. The drum is then cleaned and discharged ready to receive further images. Such processes are exemplified by the well-known xerographic printer.

In these known processes the image received on the drum comprises the content of an entire page of print. As the image is transferred without reduction in size a large, expensive drum must be employed and there are penalties in such usage which must be accepted, such as the requirement of a high charging voltage of the order of 7,000 volts and slow image formation times which result from the very large inherent capacitance of the drum's surface and slow image development time. Machines using these processes therefore very often take the form of floor-mounted consoles and considerable care is taken to protect the user from the high voltage circuitry contained therein.

It is a first object of the invention to provide a new and improved printing head by means of which one can construct, for example, a typewriter without moving type or, similarly, a computer print-out terminal or telex terminal; or one can construct a hand-held printer which may be used, inter alia, to overprint labels or dimension and title drawings, or an X-Y plotter. It is a further object of the invention to provide electrostatic printing apparatus in which the image development time is greatly reduced. It is yet a further object of the invention to provide electrostatic printing apparatus in which an electrostatic image is continuously formed on a print drum of greatly reduced diameter and continuously printed out and in which image formation on the drum, development thereof and printout from the drum all occur in the same revolution of the drum.

SUMMARY OF INVENTION

In accordance with one aspect of the present invention there is provided a print head comprising in combination:

(a) housing means;

(b) a print drum supported for rotation about an axis in said housing means, said print drum having a cylindrical surface formed by a uniform dielectric layer on a conductive cylindrical former, and said housing means incorporating a printing station at which the print is transferred to said print medium;

(c) means for connecting said conductive former to a first potential source;

(d) an image forming means positioned in said housing means adjacent said drum and at a position spaced circumferentially with respect to the printing station, said image forming means comprising an array of electrodes each for connection to a respective pulse source means and each extending into direct physical contact with the dielectric layer on the periphery of the drum, said array extending over the width of the drum;

(e) means for detecting the angular displacement of the drum due to rotation thereof in the housing;

(f) means connected to said respective pulse source means and to said means for detecting the angular displacement of the drum for selectively enabling the pulse source means whereby the electrodes are pulsed in a prescribed sequence with a voltage signal derived from a second potential source in response to the angular displacement of the drum so as to form a charge image of one or more preselected characters on said dielectric surface; and (g) inking means positioned in said housing means adjacent the said drum and between the image forming means and the printing station, said inking means including means for supplying ink and means for applying said ink to the drum after said charge image has been formed and before the charge image has reached the printing station as a result of rotation of the drum whereby print corresponding to one or more characters is formed by ink adhering to the charged areas on the dielectric surface of the drum, said ink applying means comprising at least one electrode means for connection to a third potential source which is spaced from said drum and is arranged so that the electrostatic field which is formed as each charge image passes the electrode means causes transfer of ink from the ink applying means to the areas on the drum on which the charge defining the charge image is confined.

The applications of the invention are many. With the drum extended axially to accommodate a line of print the invention can take the form of a continuous high speed line printer capable of accepting data at the rate at which such data may, for example, be read out from memory, or a teleprinter or G.P.O. terminal, or a typewriter in which (other than the paper feed and the rotation of the drum and possibly the inking means) there are no moving parts. Alternatively, with the axial length of the drum somewhat more limited, it can take the form of a hand-held printer for printing labels and printing legends on drawings or of a direct copier by means of which characters may be reproduced in print as they are scanned, which applications are clearly impossible with the said prior equipment not only by reason of the safety hazard resulting from the presence of very high drum voltages but because of the development techniques. Another application of such a construction would be an X-Y plotter capable of being pre-programmed to draw diagrams or detail drawings, i.e. provide dimensioning, and such an arrangement can also be adapted to copy from drawings directly. The drum can be made very small indeed, even as little as, for example, one tenth of an inch diameter.

BRIEF DESCRIPTION OF DRAWINGS

These and other objects, advantages and/or applications of the invention will appear from the following descriptions of embodiments taken with reference to the accompanying drawings, in which:

FIG. 2A is a sectional view of the housing along the plane A—A of FIG. 2;

FIG. 3 shows schematically, but in enlarged detail, an electrostatic probe suitable for the print head of FIG. 2;

FIG. 4 shows diagrammatically and in sectional elevation the arrangement of the components in the print head of FIG. 2 adjacent to the printing window;

FIG. 5 is a broken view of a modified form of the bottom shell of the print head illustrated in FIG. 2 and in which the particulate material feed arrangement is replaced by a liquid ink feed arrangement.

DESCRIPTION OF EMBODIMENTS

Figure 1:
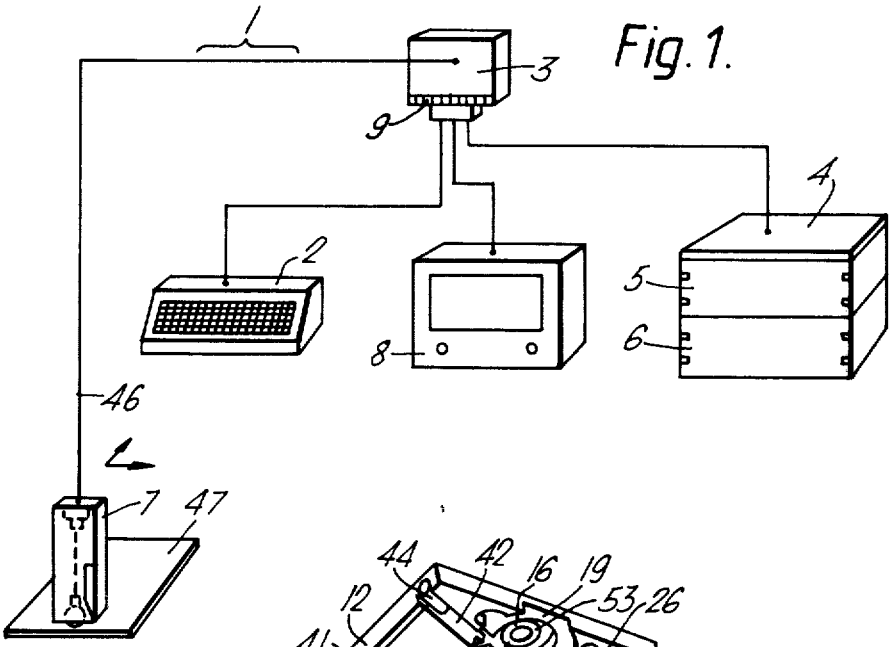
FIG. 1 shows a printing system including a hand-held printing head in accordance with the invention.

Referring now to FIG. 1, there is shown a printing system 1 using a hand-held printing head constructed in accordance with the invention. As seen in FIG. 1, the said system comprises a keyboard 2 of conventional form which via an interface and power supply 3 transmits to a processor 4 coded signals representative of the characters keyed into the system by means of the keyboard. Processor 4 comprises a character generator 5 which may be of conventional design and which generates signals from which the required images of the characters are subsequently formed. These signals may be stored in memory 6 from whence they are read out at a rate which is determined solely by the rotation of the printing drum in a print head 7. These signals are utilised to enable a set of pulse drivers 9 in the interface 3 which are coupled to an array of electrodes also in the print head 7. The memory content may be displayed prior to printing on a video monitor 8 and an automatic memory erasure facility following printout may be incorporated. With the exception of the print head 7, the components may all be compactly contained within the keyboard housing and they are all commercially available or at least exist in a form which can be adapted to suit the described system by well known and well understood techniques. Except insofar as the operation of the system is described later the known components will not be further described herein.

Figure 2:
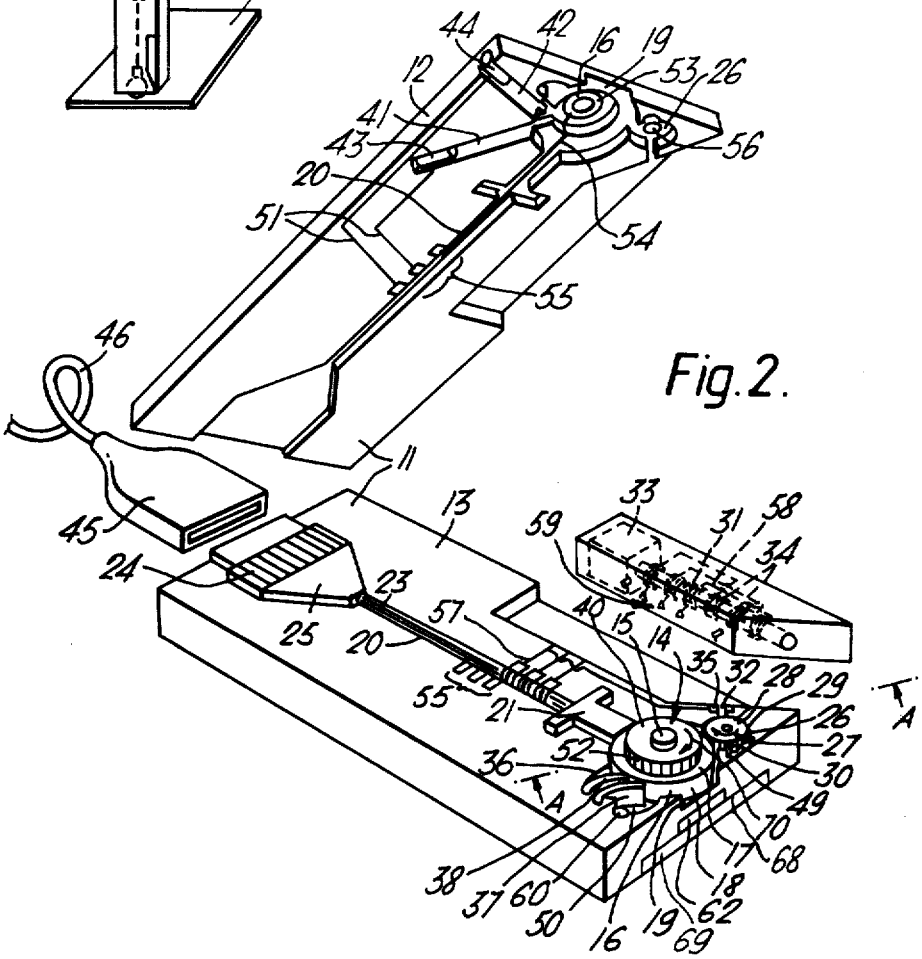
FIG. 2 shows in diagrammatic form an exploded view of the print head according to the invention.

Referring now to FIGS. 2–4, one embodiment of a print head 7 comprises a housing 11 shaped to fit comfortably in the hand and formed of insulating plastics material. As an aid to assembly, the housing is split longitudinally into two shells 12, 13 which are normally fastened together, for example by means of screws (not shown). A printing drum 14 having a diameter which may range between one tenth of an inch to an inch or more is journalled for rotation about an axis 15 within a first cavity 16 in the said housing. Drum 14 has a metal hub 17 and an outer cylindrical rim 18, of selenium, MYLAR (RTM) or other dielectric material, which defines an outer, cylindrical, electric charge retaining surface on which the print characters are developed. A print transfer window 19 through which a small portion of the rim 18 of the drum 14 projects is situated at one end of the print head and is defined by the intersection of the said first cavity 16 with an end wall of the housing 11. A longitudinal cavity 20 defining the image forming station extends through the housing 11 from the end remote from the print transfer window 19, intersecting the said first cavity 16 at a position diametrically opposite to that of the print transfer window, and contains, snugly fitting within it, an electrostatic probe 21 which has a plurality of electrodes 22 arranged longitudinally within the probe in a character defining pattern. Each said electrode 22 comprises an electrically conductive rod which extends at one end into direct contact with the dielectric surface of the drum 14 and at the other end to a terminal (not shown) which is connected via a conductor in the cable 23 to a respective contact 24 on the multi-contact socket 25. The latter is disposed in said longitudinal cavity 20 at the end remote from the printing window 19 and receives a plug 45 through which the electrodes are coupled to respective pulse drivers (not shown) situated in the interface 3. The probe drivers provide positive voltage pulses on the electrodes derived from a first potential source in said interface. As shown there are seven electrodes present in the probe but, depending upon the parameters of the character generator, many more may be provided so that the definition of the characters being printed can be enhanced. The materials which may be used for the electrodes may comprise carbon, conductive plastics or conductive rubber, and in the case where the surface of the drum is formed by a polymer such as Mylar TM metal may be used. The direct contact of the electrodes with the drum surface assures a very rapid formation of the charge image on the drum and typically the charging time is a few microseconds. Further, because of this direct contact, the electrode voltage is selected to be the same as the residual charge impressed on the drum, i.e. of the order of 2–700 volts. Thus the arrangement offers the advantages over conventional methods of reduced size, increased speed and reduced working voltages.

A metal bearing insert 53 in the housing 12 (see FIG. 2A), connected via the conductor 54, opposed contact pairs 55 on the mating surfaces of the two halves of the housing, the cable 23 and the multi-contact plug and socket 25, 45 couples the metal hub 17 of the drum 14 to a second reference potential provided in the interface 3. Preferably this potential is earth.

Also intersecting cavity 16 is a further cavity 26 defining the development station in which there is received an inking roller 27 receiving magnetic ink. Roller 27 is journalled in metal bearing inserts in housing 11 (see FIG. 2A reference 56) so as to rotate about an axis which is parallel with the said axis 15 of the drum 14. It has a metal hub 28 and an outer rim 29 2–3 thousandths of an inch thick which is formed of an electrically conductive rubber having magnetic particles uniformly entrained within the rubber. Some of these magnetic particles are permanently magnetised within the rubber so as to form around the peripheral surface of the roller 27 a succession of elongate poles 30 of alternate polarity each of which stretches across the length of the roller. The latter is positioned so as to be spaced apart from but to almost contact drum 14 and is caused to rotate when drum 14 rotates so that the poles of the roller sweep over the adjacent surface of the drum. A doctor blade 49 is positioned adjacent the roller 27 and controls the thickness of the ink film on the roller so that it is not so thick as to brush the surface of the drum.

An electrical connection (not shown) between the metal bearing insert 56 in housing shell 13 and the socket 25 couples the metal hub 28 of roller 27 to a third source of electrical potential (not shown) which may provide a negative bias voltage thereon of about −130 volts.

The provision of a distance separating the surface of the roller from the drum is essential because it is in the gap between them that the development process is controlled. In this respect, the thickness of the magnetic rubber layer, the thickness of the ink layer and the gap between the ink layer and the outer charge-retaining surface of the drum are all inter-related and must be selected to give the best results. All these dimensions are very small, of the order of a few thousandths of an inch. This configuration together with the small diameter of the drum and inking roller provides for an intense electrostatic field in the zones between the drum and the roller lying immediately on each side of the plane containing the two respective axes of rotation and a very low intensity fringing field and this in turn enables the development process to be confined within a very small space and gives rise to very rapid image inking. For example the ink development times may be as short as a few milliseconds in duration. Workers skilled in the art will recognise this short time to be an outstanding improvement which overcomes many previous problems associated with ink development.

A duct 31, having an orifice adjacent an orifice 32 in the cylindrical boundary wall of cavity 26 adjacent to the inking roller 27, extends to the housing from within a small toning powder hopper 33 mounted on the outside of the housing. A succession of toroidal electromagnetic coils 34 are disposed along the length of the duct, and another, 35, is provided in the housing shell 13 at said orifice 32. Electromagnetic coils 34, 35 are pulsed periodically and sequentially by an external electrical pulsing means (not shown) connected thereto via the plug 45, cable 20 connected to the plug 45, conductors 57 and 58, and pairs of facing contacts 59 on the hopper 33 and the housing shell 13. This sequential pulsing causes dry magnetisable toning powder to be pulled through the duct from the hopper to the said inking roller at a predetermined rate. Alternatively, in this hand-held device, powder may be allowed to flow from the hopper under the action of gravity.

Yet a further cavity 36 intersects cavity 16 on the opposite side of the longitudinal axis of the housing to that in which the said cavity 26 is situated. Within this cavity are arranged a pair of arcuate resilient conductive rubber leaves 37, 38 which bear against the surface of the drum so as to remove therefrom any traces of ink and electrical charge contained on the periphery of the drum as it passes thereby. These conductive leaves are connected to said first reference voltage source via a further cable (not shown) and socket 25. The debris arising from the cleaning action accumulates in sump 50 where it is retained for later removal by a small permanent magnet 60 inset in the housing shell 13.

Printing drum 14 is provided with a reduced diameter axial end portion 40 the cylindrical surface of which is given a high degree of polish and contains deposited thereon a surface pattern 52, e.g. a sequence of bars and spaces parallel to the rotational axis which encodes the angular position of the drum relative to the housing. The respective half of the housing 11 receiving the reduced diameter portion of the drum contains two passages 41, 42 in a plane normal to the axis 15 of the drum, which passages intersect the said cavity 16 and one another, the point of intersection being arranged at the surface of the reduced diameter portion 40 of the said drum. These passages are arranged at equal angles to the same tangent to the drum portion 40. In passage 41 is provided a light source 43 whilst in passage 42 is provided a photo-detector 44. Conductors 51 from the said light source and photo-detector connect the latter devices to respective contacts on the socket 25 via mating corresponding contacts 55 on the joining surfaces of the respective shells 12, 13. Plug 45 and connecting cable 46 provide electrical connection between the print head 7 and the said interface and power supply 3.

As best seen in FIG. 2A shell 13 is provided with a further cavity 61 in its underside in substantially vertical registration with cavities 16 and 26. Cavity 61 intersects the end wall of shell 13 to define a further window 62 alongside window 19. Axle 63 projects part way into the cavity 61. A large pulley 64 is fixed onto the end of the axle 63 so as to rotate with the drum. Axle 65 on which roller 27 is fixed also projects part way into cavity 61 and mounts for rotation therewith a relatively small pulley 66. A continuous rubber belt 67 of circular cross-section is stretched around pulleys 64 and 66 and partially projects through the window 62 slightly beyond the drum 14. A recess 68 receives a cover 69 which may be fastened therein by any suitable means.

The system of FIGS. 1–4 operates in the following manner. A line of data is stored in the memory 6 either as a consequence of a data processing operation or of a keying-in of data by the operator via the keyboard 2. This information is displayed on the screen of the video monitor 8. Having assured himself that the data is present and the system made ready to print out, the operator places the print head 7 on the surface 47 on which he wishes to print such that the parts of the rubber belt 67 and the printing drum 14 projecting through the windows 19 and 62 are in contact with the said surface and the print head faces the direction in which the print is to appear. Then, pressing the print head firmly on the said surface, he runs it across the surface in the required direction. As a consequence of friction between the rubber belt 67 and the surface to be printed, the drum is caused to rotate as shown by the arrow 70 as the printing head is moved across the surface thereby bringing different portions of the pattern 52 on the cylindrical surface of portion 40 of the drum 14 into registration with the beam of light from light source 43 and the photodetector 44. Appropriately coded signals are detected by the photo-detector 44 and transmitted back to the character generator via contacts 55, cables 23 and 46 and the plug and socket 25, 45 and the said interface 4. The character generator then generates a series of voltage pulses, related in time to the drum position, which are transmitted to the electrodes 22 of the probe 21 whereby electrostatically charged zones representing character images in dot form are formed successively on the surface of the drum. Movement of the rubber belt 67 results in the rotation of the inking roller 27 in the same direction as the print drum, i.e. so that the adjacent peripheries of the print drum and inking roller are moving rectilinearly in opposite directions. As the portions of the drum containing the charged zones come into registration with the inking roller 27 the ink powder thereon, which has been attracted to the roller by its magnetic properties, is transferred electrostatically across the gap to the printing drum surface in the regions where the charge exists as a result of the difference of electrical potential between the charged zones on the drum and the hub of the roller. The pressure of the printing drum on the surface to be printed then transfers this powder to the said surface where it is caused to fuse thereon in the manner already well known in the art by the pressure of the drum. Any powder remaining on the drum surface after printout and the localised charges are removed by the conductive rubber leaves 38 before that part of the drum again comes under the influence of the probe 21. As the characters are printed out they are automatically cancelled from the screen of the video monitor 8.

It will be seen in this operation that images of the characters being printed are continuously and successively formed on the drum and then transferred to the surface which is being printed upon at whatever rate the operator moves the print head across the said surface. It will also be seen by workers skilled in the art that the mechanisms involved are readily adaptable to the construction of a line printer in which the drum in the print head has an axial length equal to the length of the line being printed and is rotated by any conventional means at the rate at which paper is fed past a printing station. For each column of print a separate electrostatic probe 21 mounted adjacent the drum is provided. Alternatively the charging means may comprise a plurality of coaxially mounted rotatable conductive discs (not shown) replacing the electrodes 22 and electrically equivalent thereto, each disc being insulated from its neighbour by a spacer and being energised by a respective contacting brush connected to the character generator. Several such assemblies of discs, corresponding in function to the electrode assembly may be provided, said assemblies being staggered around the drum.

Instead of the dry toning powder a fluid ink may be employed and the means for the application of this ink to the printing drum may take several forms. For example one arrangement 71 is shown in FIG. 5. A pair of fixed spaced-apart arcuate shaped members or shoes 72, 73 are mounted by means of supporting posts 74, 75 on an insulating block 76 which is positioned adjacent to the drum. The shoes are arranged side by side and one behind the other with respect to the drum rotation, and replace the previously described inking roller. Each arcuate member comprises a sintered bronze layer 77, presenting a porous concave surface to the printing drum, disposed on a solid bronze substrate 78. A capillary passage 79 extends through each respective supporting post and the respective substrate from the interface between the sintered bronze layer and substrate to the bottom mountings of the supporting post whereat a respective duct is coupled (not shown). A prewetting solution stored in a compartment in a container 48, e.g. paraffin, is fed to the leading shoe 72 through the respective duct and passage. Leading shoe 72 is electrically connected to the same reference potential as the hub of the drum. A supply of liquid ink relying on capillary action is provided to the trailing shoe 73 through its respective passage from a second compartment in container 48. This shoe is electrically biased to a potential of about +90 v. The gap 80 between the arcuate members is carefully adjusted to ensure that only an appropriate degree of prewetting of the drum occurs and that the migration of the toner particles within the ink solution is controlled. In this arrangement it is advantageous to provide connections (not shown) to the print head for positive fluid and vacuum pressures (for the removal of the exhausted ink).

An alternative arrangement, which may be adopted, is to supply a liquid ink directly through capillaries provided in the electrodes 22 of the probe 21. In this arrangement the electrostatic field provided by the voltage pulses on the electrodes will also serve to transfer ink from the electrodes to the printing drum. The aforesaid advantages with respect to charging and development times are present in this embodiment.

Whilst only the hand manipulated embodiment of the invention has been described in detail it will be apparent to those skilled in the art that the invention is adaptable to take the form of a printer in which the print receiving medium is transported past the printing station during the printing operation. The invention is therefore limited only by the scope of the following claims.

I claim:

1. In a printer of the type in which print is formed on a drum by an electrostatic process and is transferred therefrom onto a print receiving surface of a print medium by means solely of pressure acting between the print medium and the drum, an improved head comprising in combination:

housing means;

a print drum supported for rotation about an axis in said housing means, said print drum having a cylindrical surface formed by a uniform dielectric layer on a conductive cylindrical form, and said housing means incorporating a printing station at which the print is transferred to said print medium;

means for connecting said conductive form to a first potential source;

an image forming means positioned in said housing means adjacent said drum and at a position spaced circumferentially with respect to the printing station, said image forming means comprising an array of electrodes each for connection to a respective pulse source means and each extending into direct physical contact with the dielectric layer on the periphery of the drum, said array extending over the width of the drum;

means for detecting the angular displacement of the drum due to rotation thereof in the housing;

means connected to said respective pulse source means and to said means for detecting the angular displacement of the drum for selectively enabling the pulse source means whereby the electrodes are pulsed in a prescribed sequence with a voltage signal derived from a second potential source in response to the angular displacement of the drum so as to form a charge image of one or more preselected characters on said dielectric surface;

inking means positioned in said housing means adjacent the said drum and between the image forming means and the printing station, said inking means including means for supplying ink and means for applying said ink to the drum after said charge image has been formed and before the charge image has reached the printing station as a result of rotation of the drum whereby print corresponding to one or more characters is formed by ink adhering to the charged areas on the dielectric surface of the drum, said ink applying means comprising at least one electrode means for connection to a third potential source which is spaced from said drum and is arranged so that the electrostatic field which is formed as each charge image passes the electrode means causes transfer of ink from the ink applying means to the areas on the drum on which the charge defining the charge image is confined;

the electrode means of the ink applying means comprising a cylindrical roller arranged for rotation in said housing on an axis parallel to the axis of rotation of said drum and means for rotating the roller when the said drum rotates at a rate proportional thereto, said roller being of considerably smaller diameter than the drum and being spaced therefrom at such a distance that the surface of the drum and the facing surface of the roller closely approach one another only along the plane containing the two axes of rotation;

the ink for use by the ink supplying means being a dry particulate material comprising appropriate pigments and magnetizable material all carried in a pressure fusible resin base and said inking roller having an outer surface formed by a sleeve of electrically conductive rubber wherein magnetic particles are entrained, said sleeve being premagnetized across the length of the roller in discrete spaced apart bands around the periphery thereof; and a hopper means for containing a supply of ink and having an ink feed outlet, electromagnetic ink feeding means consisting of a series of coils arranged along a duct which extends from the hopper ink feed outlet through the housing means to the said roller and means for sequentially energising said coils so as to effectively pull the particulate material along the duct from the hopper to the roller.

2. In a printer of the type in which print is formed on a drum by an electrostatic process and is transferred therefrom onto a print receiving surface of a print medium by means solely of pressure acting between the print medium and the drum, an improved head comprising in combination:

housing means;

a print drum supported for rotation about an axis in said housing means, said print drum having a cylindrical surface formed by a uniform dielectric layer on a conductive cylindrical form, and said housing means incorporating a printing station at which the print is transferred to said print medium;

means for connecting said conductive form to a first potential source;

an image forming means positioned in said housing means adjacent said drum and at a position spaced circumferentially with respect to the printing station, said image forming means comprising an array of electrodes each for connection to a respective pulse source means and each extending into direct physical contact with the dielectric layer on the periphery of the drum, said array extending over the width of the drum;

means for detecting the angular displacement of the drum due to rotation thereof in the housing;

means connected to said respective pulse source means and to said means for detecting the angular displacement of the drum for selectively enabling the pulse source means whereby the electrodes are pulsed in a prescribed sequence with a voltage signal derived from a second potential source in response to the angular displacement of the drum so as to form a charge image of one or more preselected characters on said dielectric surface;

inking means positioned in said housing means adjacent the said drum and between the image forming means and the printing station, said inking means including means for supplying ink and means for applying said ink to the drum after said charge image has been formed and before the charge image has reached the printing station as a result of rotation of the drum whereby print corresponding to one or more characters is formed by ink adhering to the charged areas on the dielectric surface of the drum, said ink applying means comprising at least one electrode means for connection to a third potential source which is spaced from said drum and is arranged so that the electrostatic field which is formed as each charge image passes the electrode means causes transfer of ink from the ink applying means to the areas on the drum on which the charge defining the charge image is confined;

the electrode means of the ink applying means comprising a cylindrical roller arranged for rotation in said housing on an axis parallel to the axis of rotation of said drum and means for rotating the roller when the said drum rotates at a rate proportional thereto, said roller being of considerably smaller diameter than the drum and being spaced therefrom at such a distance that the surface of the drum and the facing surface of the roller closely approach one another only along the plane containing the two axes of rotation;

the ink for use by the ink supplying means being a dry particulate material comprising appropriate pigments and magnetizable material all carried in a pressure fusible resin base and said inking roller having an outer surface formed by a sleeve of electrically conductive rubber wherein magnetic particles are entrained, said sleeve being premagnetized across the length of the roller in discrete spaced apart bands around the periphery thereof; and a doctor blade means disposed alongside the roller parallel to the axis of rotation of the roller and spaced from the outer surface thereof so as to control the formation and thickness of a film of ink on the said surface particularly on that portion instantly about to come into correspondence with the said drum as a consequence of rotation of the roller.

3. In a printer of the type in which print is formed on a drum by an electrostatic process and is transferred therefrom onto a print receiving surface of a print medium by means solely of pressure acting between the print medium and the drum, an improved head comprising in combination:

housing means;

a print drum supported for rotation about an axis in said housing means, said print drum having a cylindrical surface formed by a uniform dielectric layer on a conductive cylindrical form, and said housing means incorporating a printing station at which the print is transferred to said print medium;

means for connecting said conductive form to a first potential source;

an image forming means positioned in said housing means adjacent said drum and at a position spaced circumferentially with respect to the printing station, said image forming means comprising an array of electrodes each for connection to a respective pulse source means and each extending into direct physical contact with the dielectric layer on the periphery of the drum, said array extending over the width of the drum;

means for detecting the angular displacement of the drum due to rotation thereof in the housing;

means connected to said respective pulse source means and to said means for detecting the angular displacement of the drum for selectively enabling the pulse source means whereby the electrodes are pulsed in a prescribed sequence with a voltage signal derived from a second potential source in response to the angular displacement of the drum so as to form a charge image of one or more preselected characters on said dielectric surface;

inking means positioned in said housing means adjacent the said drum and between the image forming means and the printing station, said inking means including means for supplying ink and means for applying said ink to the drum after said charge image has been formed and before the charge image has reached the printing station as a result of rotation of the drum whereby print corresponding to one or more characters is formed by ink adhering to the charged areas on the dielectric surface of the drum, said ink applying means comprising at least one electrode means for connection to a third potential source which is spaced from said drum and is arranged so that the electrostatic field which is formed as each charge image passes the electrode means causes transfer of ink from the ink applying means to the areas on the drum on which the charge defining the charge image is confined; and wherein the ink used by the ink applying means comprises a liquid ink, and the said ink applying means comprises first and second metal arcuate shoes electrically insulated from one another and arranged in close proximity to the drum cylindrical surface, the first shoe for connection to said first potential source and the said second shoe being disposed behind the first shoe relative to the rotation of the drum with a narrow gap therebetween parallel to the axis of rotation of the drum and comprising said electrode means for connection to a third potential source, each shoe having a porous layer on the side thereof adjacent to the drum disposed upon an impervious substrate in which substrate there is provided a duct which extends from the underside of the porous layer to a respective fluid source, the duct in said first shoe being for connection to a source of pre-wetting fluid and the duct in said second shoe being for connection to the source of liquid ink.

4. A print head according to claim 3 wherein the impervious substrate of each shoe is formed of bronze and the respective porous layer is formed from sintered bronze.

5. A print head according to claim 4 wherein said ducts comprise capillary ducts.

* * * * *